US011740020B2

(12) United States Patent
Blomquist

(10) Patent No.: US 11,740,020 B2
(45) Date of Patent: Aug. 29, 2023

(54) UNIDIRECTIONAL MULTI-PATH LUMBER KILNS

(71) Applicant: USNR, LLC, Woodland, WA (US)

(72) Inventor: Christopher W. Blomquist, Ridgefield, WA (US)

(73) Assignee: USNR, LLC, Woodland, WA (US)

( * ) Notice: Subject to any disclaimer, the term of this patent is extended or adjusted under 35 U.S.C. 154(b) by 0 days.

(21) Appl. No.: 17/222,865

(22) Filed: Apr. 5, 2021

(65) Prior Publication Data

US 2021/0222952 A1 Jul. 22, 2021

Related U.S. Application Data

(63) Continuation of application No. 16/234,479, filed on Dec. 27, 2018, now Pat. No. 10,969,172, which is a (Continued)

(51) Int. Cl.
*F26B 15/14* (2006.01)
*F26B 25/08* (2006.01)

(Continued)

(52) U.S. Cl.
CPC ..... *F26B 15/14* (2013.01); *F26B 3/04* (2013.01); *F26B 15/00* (2013.01); *F26B 15/10* (2013.01);

(Continued)

(58) Field of Classification Search
CPC .. F26B 15/14; F26B 3/04; F26B 15/00; F26B 15/10; F26B 25/06; F26B 25/08; F26B 2210/16; Y10T 29/49716

(Continued)

(56) References Cited

U.S. PATENT DOCUMENTS 1,353,591 A * 9/1920 Hope ..... F26B 15/00 34/538
1,784,727 A * 12/1930 Harris ..... F26B 9/06 34/223

(Continued)

FOREIGN PATENT DOCUMENTS

CA 2847005 A1 * 6/2014 ..... F26B 15/00
EP 2402691 A2 * 1/2012 ..... F26B 21/06

(Continued)

OTHER PUBLICATIONS

United States Patent Office—Office Action dated Aug. 19, 2021 from U.S. Appl. No. 16/219,926, 14 pages.

(Continued)

*Primary Examiner* — Stephen M Gravini
(74) *Attorney, Agent, or Firm* — Schwabe, Williamson & Wyatt, P.C.

(57) ABSTRACT

Embodiments provide a unidirectional multi-path kiln with two or more chambers and generally parallel flow paths extending through the kiln, on opposite sides, from charge entry portals at a first end of the kiln to charge exit portals at a second end of the kiln. Moist heated air flowing from the second heated chamber is received in the first chamber and circulated around the lumber charges with one or more fans. The lumber charges proceed in the same direction on the flow paths through the heated second chamber, which may be an existing kiln. Charge exit portals at the distal end of the kiln and/or intermediate charge portals between the second chamber and a third chamber may be provided with insulating members configured to reduce airflow from the second chamber through the charge exit portals.

22 Claims, 10 Drawing Sheets

Related U.S. Application Data continuation of application No. 15/652,179, filed on Jul. 17, 2017, now Pat. No. 10,203,156, which is a continuation of application No. 15/284,404, filed on Oct. 3, 2016, now Pat. No. 9,709,328, which is a continuation of application No. 14/509,888, filed on Oct. 8, 2014, now Pat. No. 9,482,465, which is a continuation of application No. 14/201,722, filed on Mar. 7, 2014, now Pat. No. 8,875,414.

(60) Provisional application No. 61/802,196, filed on Mar. 15, 2013.

(51) Int. Cl.

| | |
|---|---|
| ***F26B 3/04*** | (2006.01) |
| ***F26B 15/10*** | (2006.01) |
| ***F26B 15/00*** | (2006.01) |
| ***F26B 25/06*** | (2006.01) |

(52) U.S. Cl.
CPC ..... *F26B 25/06* (2013.01); *F26B 25/08* (2013.01); *F26B 2210/16* (2013.01); *Y10T 29/49716* (2015.01)

(58) Field of Classification Search
USPC ..... 34/492
See application file for complete search history.

(56) References Cited

U.S. PATENT DOCUMENTS

| | | | | | |
|---|---|---|---|---|---|
| 2,834,120 | A * | 5/1958 | Greenhood | F26B 21/04 | 34/225 |
| 3,981,338 | A | 9/1976 | Jones | | |
| 4,182,048 | A * | 1/1980 | Wolfe | F26B 3/04 | 34/396 |
| 4,955,146 | A * | 9/1990 | Bollinger | F26B 21/02 | 34/191 |
| 5,138,773 | A * | 8/1992 | Goodwin | F26B 25/08 | 432/248 |
| 5,195,251 | A * | 3/1993 | Gyurcsek | F26B 21/024 | 34/566 |
| 6,119,364 | A * | 9/2000 | Elder | F26B 3/04 | 34/232 |
| 6,219,937 | B1 * | 4/2001 | Culp | F26B 21/02 | 432/103 |
| 6,243,970 | B1 * | 6/2001 | Culp | F26B 25/185 | 34/518 |
| 6,467,190 | B2 * | 10/2002 | Nagel | F26B 23/028 | 432/103 |
| 6,601,317 | B2 * | 8/2003 | Nardi | F26B 21/028 | 34/223 |
| 7,849,894 | B2 * | 12/2010 | Strebig | B27B 31/04 | 144/1.1 |
| 7,963,048 | B2 * | 6/2011 | Pollard | F26B 15/12 | 62/304 |
| 7,987,614 | B2 * | 8/2011 | Erickson | F26B 7/00 | 34/210 |
| 8,201,501 | B2 * | 6/2012 | Tinsley | F26B 15/16 | 34/396 |
| 8,342,102 | B2 * | 1/2013 | Tinsley | F26B 15/16 | 34/396 |
| 8,875,414 | B2 * | 11/2014 | Blomquist | F26B 25/08 | 34/396 |
| 9,127,882 | B2 * | 9/2015 | Jenkins | D06F 58/30 | |
| 9,482,465 | B2 * | 11/2016 | Blomquist | F26B 15/00 | |
| 9,500,408 | B2 * | 11/2016 | Spangler | F26B 25/004 | |
| 9,709,328 | B2 * | 7/2017 | Blomquist | F26B 25/06 | |
| 9,725,248 | B2 * | 8/2017 | Saastamo | B27B 5/18 | |
| 9,726,429 | B1 * | 8/2017 | Jamaluddin | F26B 25/002 | |
| 9,746,239 | B2 * | 8/2017 | Grabolle | F26B 25/12 | |
| 9,841,234 | B2 * | 12/2017 | Stahl | F26B 3/283 | |
| 9,874,397 | B1 * | 1/2018 | Ball, Jr. | F26B 21/022 | |
| 9,964,359 | B2 * | 5/2018 | Blomquist | F26B 15/04 | |
| 10,082,335 | B2 * | 9/2018 | Kolari | F26B 23/001 | |
| 10,161,679 | B2 * | 12/2018 | Spangler | F26B 15/12 | |
| 10,203,156 | B2 * | 2/2019 | Blomquist | F26B 3/04 | |
| 10,520,253 | B2 * | 12/2019 | Mallory | F26B 3/06 | |
| RE48,227 | E * | 9/2020 | Ball, Jr. | F26B 25/06 | |
| 10,969,172 | B2 * | 4/2021 | Blomquist | F26B 15/10 | |
| 11,085,695 | B2 * | 8/2021 | von Bargen | F26B 15/14 | |
| 11,292,706 | B2 * | 4/2022 | Showalter | B67D 1/00 | |
| 2006/0272172 | A1 * | 12/2006 | Pollard | F26B 15/12 | 34/396 |
| 2008/0066340 | A1 * | 3/2008 | Kakuno | F26B 5/04 | 34/191 |
| 2012/0023772 | A1 * | 2/2012 | Abramov | F26B 21/06 | 34/92 |
| 2021/0222952 | A1 * | 7/2021 | Blomquist | F26B 15/00 | |

FOREIGN PATENT DOCUMENTS

| | | | | |
|---|---|---|---|---|
| EP | 2972033 | B1 * | 7/2019 | F26B 15/00 |
| WO | WO-2010098698 | A3 * | 10/2010 | F26B 21/06 |
| WO | WO-2014150082 | A1 * | 9/2014 | F26B 15/00 |

OTHER PUBLICATIONS

European Patent Office—Communication pursuant to Article 94(3) EPC dated Dec. 23, 2021 from European Divisional Application No. 19187776.0, 6 pages.

* cited by examiner

UNIDIRECTIONAL MULTI-PATH LUMBER KILNS

CROSS REFERENCE TO RELATED APPLICATION

The present application is a continuation of U.S. patent application Ser. No. 16/234,479 filed Dec. 27, 2018, which is a continuation of U.S. patent application Ser. No. 15/652,179, filed Jul. 17, 2017, which is a continuation of U.S. patent application Ser. No. 15/284,404, filed Oct. 3, 2016, now U.S. Pat. No. 9,709,328, which is a continuation of U.S. patent application Ser. No. 14/509,888, filed Oct. 8, 2014, now U.S. Pat. No. 9,482,465, which is a continuation of U.S. patent application Ser. No. 14/201,722, filed Mar. 7, 2014, now U.S. Pat. No. 8,875,414, which claims priority to U.S. Patent Application No. 61/802,196, filed Mar. 15, 2013, all titled "UNIDIRECTIONAL MULTI-PATH LUMBER KILNS," the entire disclosures of which are hereby incorporated by reference.

TECHNICAL FIELD

Embodiments herein relate to the field of lumber drying, and, more specifically, to methods and systems for drying wood products in a kiln with at least two generally parallel flow paths along which charges are moved through the kiln in substantially the same direction of travel.

BACKGROUND

Green lumber is typically stacked, grouped in batches, and dried batch-wise in a kiln. The batches of lumber ("charges") are placed within an insulated chamber in the kiln, and the chamber is closed. Conditions within the chamber (e.g., air temperature, air flow direction/speed, and humidity) are set according to predetermined parameters, which may vary according to various factors such as lumber type, lumber thickness, and the starting moisture content of the lumber. The lumber is dried within the chamber for a predetermined length of time or to a predetermined moisture content. The moisture released by the lumber into the surrounding air is vented to the external surroundings. The insulated chamber is then opened to remove the dried lumber and to insert the next batch of green lumber. This exchange allows heated air and moisture to escape, requiring a readjustment of the temperature and other conditions within the chamber between successive batches of lumber.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1A:
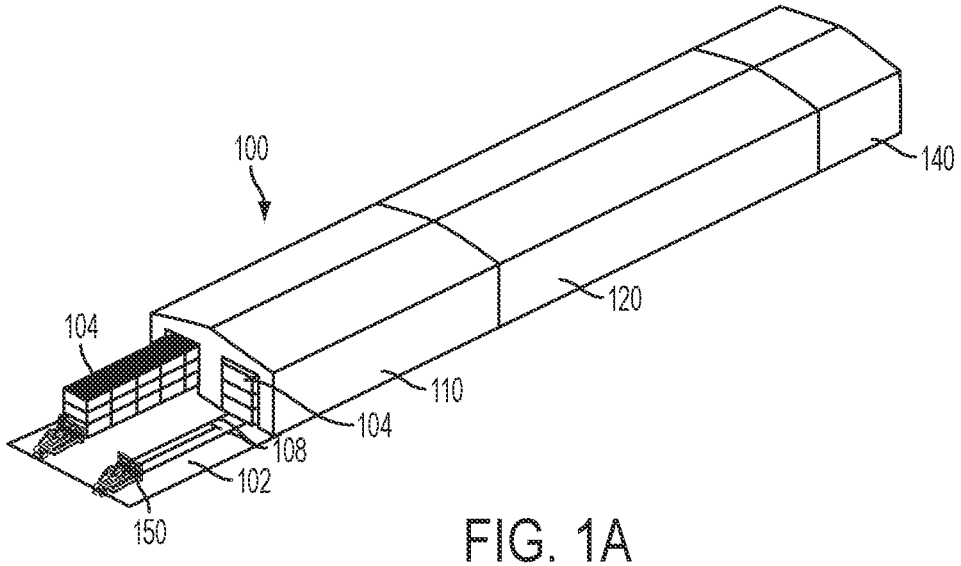
FIGS. 1A-D illustrate perspective views of unidirectional kilns.
Figure 1B:
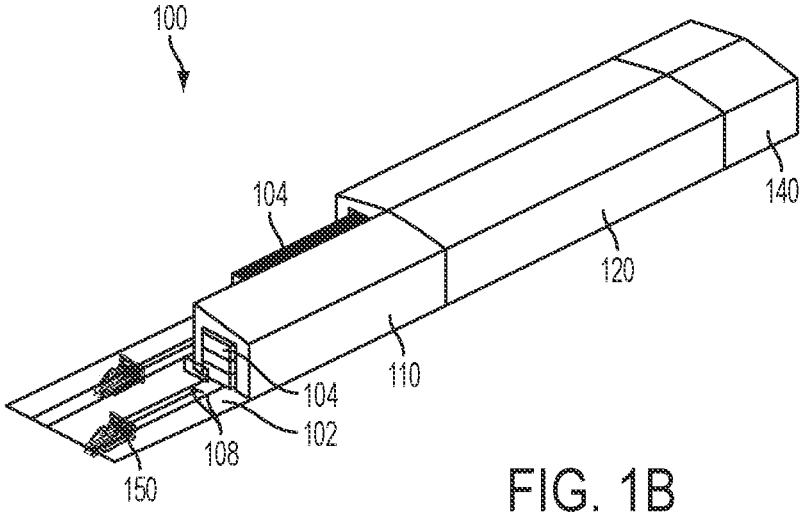
Figure 1C:
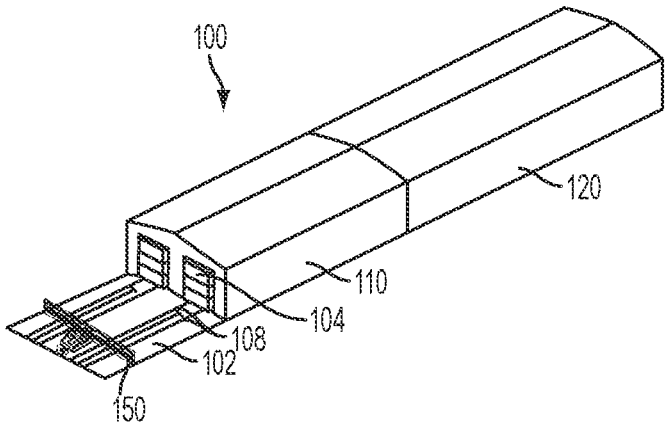
Figure 1D:
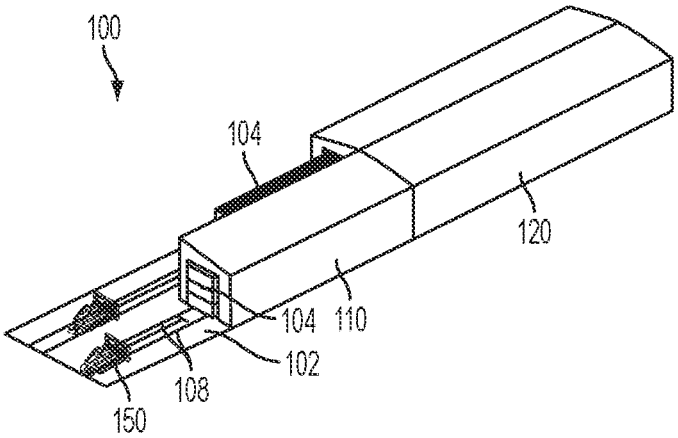

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

In various embodiments, methods, apparatuses, and systems for drying lumber products are provided. In exemplary embodiments, a computing device may be endowed with one or more components of the disclosed apparatuses and/or systems and may be employed to perform one or more methods as disclosed herein.

Lumber is typically dried in a kiln to reduce the moisture content of the wood to within an acceptable range. Lumber loses or gains moisture until reaching an equilibrium moisture content (EMC). The EMC is a function of the temperature and relative humidity of the surrounding air—as the temperature increases and/or the relative humidity decreases, the EMC decreases and the lumber loses additional moisture. Therefore, the moisture content of lumber can be decreased by adjusting temperature and humidity within the kiln. However, sudden changes in these conditions can cause the outer surfaces of the lumber to dry and shrink more rapidly than interior portions, resulting in cracks and warping.

Some mills have begun to dry lumber in continuous kilns. Conventional continuous kilns include a central heating zone with a preheating zone at the proximal end and a cooling zone at the distal end. The preheating and cooling zones are typically of equal length, and are typically 70 to 100% of the length of the central heating zone. Two parallel paths extend through the three zones, and lumber charges are conveyed through the kiln along one path or the other. Typical lengths for the heated chamber range from 96 ft to 185 ft, and each of the unheated chambers adds another 70-100% of that length. The rate at which lumber charges are transported through the heated chamber depends in part on the length of the heated chamber.

U.S. Pat. No. 7,963,048 discloses a dual path lumber kiln in which lumber flows through three zones (two unheated end zones and a heated middle zone) along one of two opposing paths with opposite directions of flow. Each end of the kiln includes the exit portal of one path and the entry portal of the other path. As dried lumber exits the drying chamber and proceeds toward the exit on one path, green lumber is traveling toward the drying chamber on the other path. The green lumber is gradually preheated by heat released by the dried lumber, and also by the condensation of water vapor (steam) from the drying chamber, which effects a transfer of energy to the lumber. In turn, the moisture released into the air by the preheated green lumber (and by the drying chamber) serves to condition the dried lumber as it cools.

This dual path counter-flow design requires a relatively large footprint. In addition to the length added by the unheated sections extending from both ends of the heated section, space must also be reserved for stacking dried lumber or green lumber at both entrances and exits.

The present disclosure provides embodiments of a dual-path unidirectional kiln. Such kilns may have a number of advantages over prior kiln designs. First, dual-path unidirectional kilns as described herein may have a comparatively smaller footprint than prior kilns. Dual-path unidirectional kilns may also have lower construction costs, better drying efficiency, and/or lower costs of use (e.g., lower energy costs). In addition, embodiments described herein can be used with a simpler and more convenient transport system. A dual-path unidirectional kiln may optionally use one device to move lumber charges along both sides of the kiln simultaneously, whereas prior designs require at least one such device for each side of the kiln. A dual-path unidirectional kiln also allows all of the lumber charges to enter at the same end, and to exit at the same end, making the handling and transport of the green and dry lumber simpler and more efficient. Such kilns can be used with simpler rail/track systems than are required for conventional counter-flow kilns. This allows a lumber mill to have a direct input path from a lumber stacker to the input end of the kiln, and a direct path from the output end of the kiln to a planer mill or other destination.

In one embodiment, a kiln may include an unheated chamber coupled to a heated chamber to form a continuous enclosure with two charge portals in or near the unheated chamber and two exit portals at the opposite end of the continuous enclosure. Optionally, a third chamber may be coupled to the distal end of the heated chamber. Two substantially parallel flow paths may extend through the continuous enclosure, and lumber charges may be conveyed through the enclosure along one or the other of the flow paths. Embodiments with a third chamber may include an additional set of exit portals that can be opened and closed to reduce heat and steam loss through the distal end of the unidirectional kiln.

The term "flow path" is defined herein as a path along which a movable support for a lumber charge travels through a kiln. In a dual-path unidirectional kiln, is two substantially parallel flow paths may extend, on opposite sides of a longitudinal axis, from an entrance at a proximal end of the kiln to an exit at a distal end of the kiln. Lumber charges may be conveyed along the parallel flow paths in substantially the same direction of travel.

FIGS. 1A-D illustrate perspective views of embodiments of a dual-path unidirectional kiln. Kiln 100 may include a first chamber 110 coupled to a second chamber 120 to form an elongated enclosure. Kiln 100 may also include a support surface 102, guide members 108, and one or more transport assemblies 150. In the illustrated embodiment, at least one transport assembly 150 is provided along each of two flow paths.

The dimensions of first and second chambers 110 and 120 can vary among embodiments. In conventional continuous flow kilns, the end sections are commonly about 70% of the length of the central heated chamber. In contrast, some embodiments of a unidirectional dual-path kiln may have end sections (first chamber 110/third chamber 140) that are shorter than in conventional kilns. Closing the distal end of the kiln may help to concentrate heat and steam in first chamber 110, allowing first chamber 110 to pre-heat/condition lumber more efficiently than in conventional kilns. Thus, in some embodiments, first chamber 110 may be 30-50%, 50-60%, or 60-70% of the length of second chamber 120. However, in other embodiments, first chamber 110 may be 70-100% or 100-150% of the length of second chamber 120. Typically, first chamber 110 has a length of 40 to 100 feet, 50 to 90 feet, 60 to 80 feet, or 65 to 75 feet. However, first chamber 110 can have any suitable length.

The length of second chamber 120 can be 40 to 160 feet, 40 to 80 feet, 50 to 90 feet, 90 to 150 feet, 100 to 140 feet, 110 to 130 feet, or 100-200 feet. Optionally, second chamber 120 may be a pre-existing kiln or portion thereof. In a particular embodiment, first chamber 110 has a length of 68 to 72 feet and second chamber 120 has a length of 115 to 125 feet. The chambers may be joined end-to-end to form a continuous enclosure. Some embodiments may include one or more internal walls or baffle within a chamber or between two chambers to control heat exchange between adjacent areas.

Figure 2A:
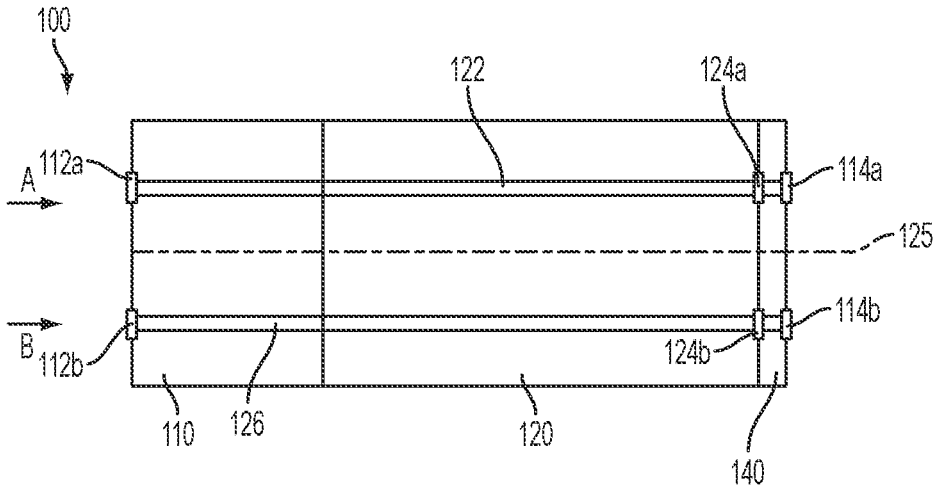
FIGS. 2A-E show a block diagram of a flow path within unidirectional multi-path kilns as illustrated in FIGS. 1A-D.
Figure 2B:
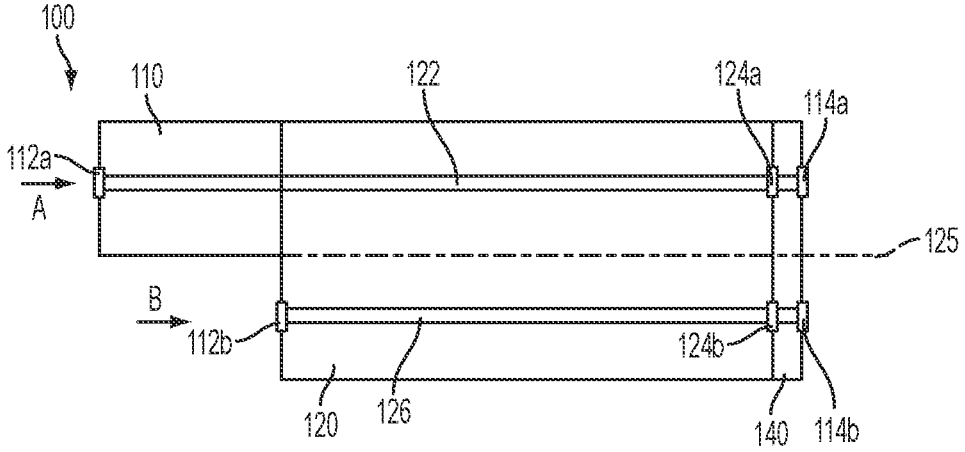
Figure 2C:
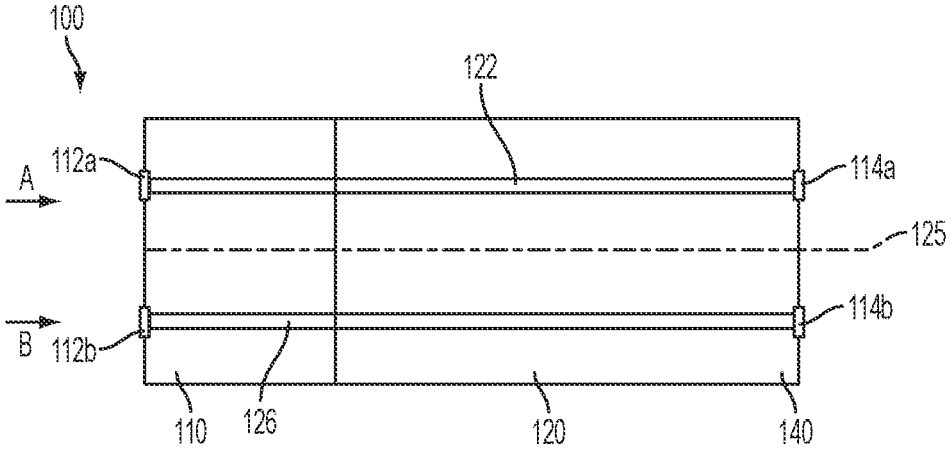
Figure 2D:
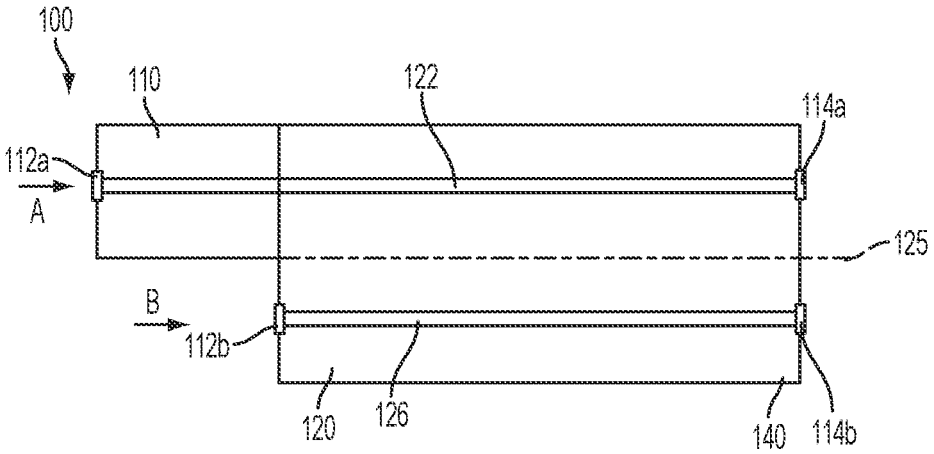
Figure 2E:
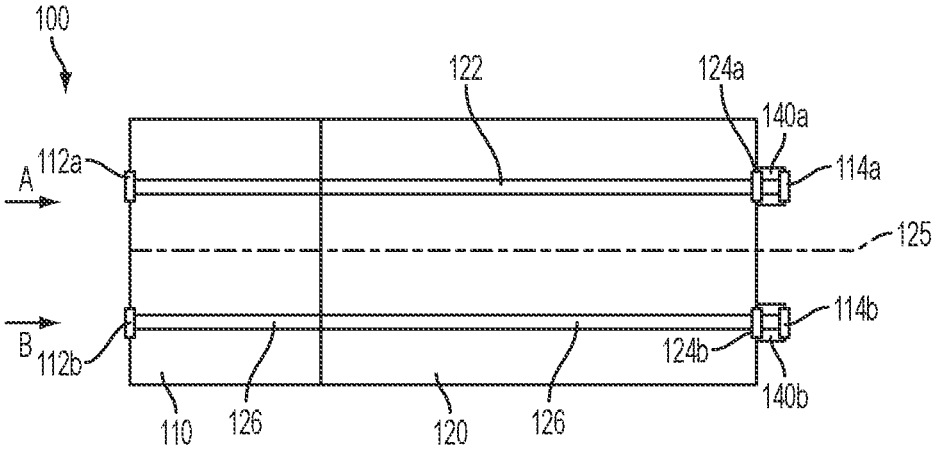

As shown in FIGS. 1*a-b*, 2*a-b*, and 2*e*, some kilns may include a third chamber 140 coupled to second chamber 120. Optionally, third chamber 140 may be provided with one or more fans and/or heaters. Third chamber 140 may have a length that is equal to, or less than, the length of first chamber 110. For example, the length of third chamber 140 may be 10 to 70 feet, 10 to 40 feet, 10 to 20 feet, 20 to 30 feet, 15 to 50 feet, or 12 to 18 feet. Third chamber 140 may be dimensioned to accommodate a single lumber charge of a standard length, or two or more lumber charges. In a particular embodiment, the sum of the lengths of first chamber 110 and third chamber 140 is less than the length of second chamber 120. In another embodiment, the combined lengths of the chambers is 120 to 220 feet (i.e., linear distance from the proximal end of first chamber 110 to the distal end of the most distal chamber of the kiln). Third chamber 140 may have the same or similar width as second chamber 120. Alternatively, as shown in FIG. 2E, third chamber 140 may be a pair of smaller chambers (140*a* and 140*b*).

Support surface 102 may form the floor of kiln 100. Optionally, support surface may extend beyond first chamber 110 and/or second chamber 120. Support surface 102 can be constructed from concrete or any other type of material suitable for use in a lumber kiln.

Guide members 108 may be coupled to support surface 102. Guide members 108 can include one or more tracks, guide members, and/or rails. Guide members 108 may be mounted to, and/or at least partially embedded in, support surface 102. In some embodiments, a guide member 108 or another guide member may be provided above or beside a flow path.

Figure 4A:
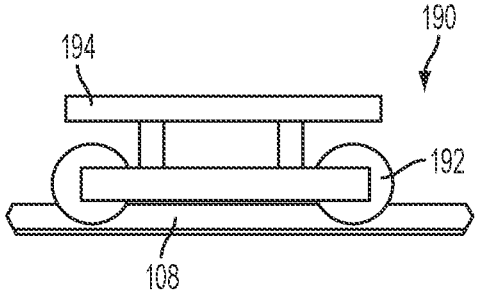
FIGS. 4A-B illustrate schematic elevational and plan views, respectively, of a movable support for a lumber charge.
Figure 4B:
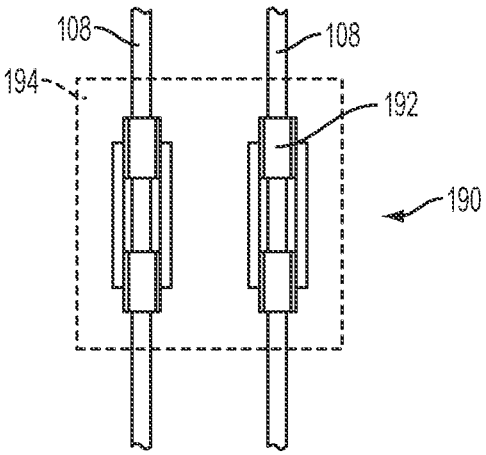

One or more movable supports 190 (see FIGS. 4A-B) may be coupled to guide member(s) 108. Movable support 190 may include a support surface coupled to one or more rotatable members. For example, movable support 190 may include a platform 194 mounted on guide member couplers 192 that are configured to engage the top/side of guide member 108. Guide member couplers 192 can be rotatable members (e.g., wheels), rigid or slideable members (e.g., pins), or other elements known in the art for movably coupling a platform to a rail, track, or the like. In any case, guide members 108 may guide the movable supports along the first and second flow paths through the kiln. Therefore, guide members 108 may define the first and second flow paths or portions thereof.

Transport assembly 150 may be coupled to movable support 190 and/or to guide member 108. Transport assembly 150 may be disposed over, under, or next to guide member 108. Transport assembly 150 can be any mechanism or device configured to push or pull one or more movable supports 190 along a flow path. In some embodiments, transport assembly 150 may include a motor or a pulley/winch coupled to movable support 190. In other embodiments, transport assembly 150 may be coupled to guide member 108. For example, the motive force mechanism may include an endless loop (e.g., a chain or belt mounted on sprockets/wheels) that extends between the first and third portions of guide member 108. Movable supports 190 may be connected to the endless loop, which may be driven to transport the lumber charges through the kiln along guide member 108.

Optionally, transport assembly 150 may be a pusher device as described in U.S. Pat. No. 8,201,501, the full disclosure of which is hereby incorporated by reference. Essentially, this pusher device is configured to travel along a track that includes two parallel rails and a chain extending between the rails. The pusher device includes a frame with a front-mounted vertical plate, axle supports, transverse support struts, and rotatably-mounted toothed gears. An axle is mounted to the frame via the axle supports, and the transverse support struts support a variable speed electric motor. A large wheel and two pulleys are mounted on the axle. The output of the electric motor is connected to the large wheel by a chain or belt. The electric motor rotates the wheel, the wheel transmits motion to the axle, the axle rotates the pulleys, and the pulleys transmit rotary motion to the toothed gear(s). The toothed gear(s) engage a link chain positioned between two rails. Rotation of the toothed gears while engaged with the link chain propels the pusher device along the pair of rails. A cable connects a source of current to the electric motor, and is carried and tensioned on a spool rotatably mounted to the housing.

Lumber may be placed onto movable support 190, and movable support 190 may be pushed, pulled, or otherwise moved in the direction of flow by transport assembly 150, and guided through the kiln along a flow path by guide member 108. In some embodiments, a single transport assembly 150 may be used to push movable supports 190 along both flow paths (see e.g., FIG. 1C). In these embodiments, transport assembly 150 may be coupled to guide members 108 of both flow paths. Alternatively, transport assembly 150 may be coupled to other guide members, such as a central track, rails, carriage, or the like. Optionally, transport assembly 150 may push two movable supports, one on each flow path, simultaneously toward/into kiln 100. In other embodiments, each flow path may be provided with a separate transport assembly 150.

Referring now to FIGS. 1A, 1C, 2A, and 2C, first chamber 110 may have a first charge entry portal 112*a* and second charge entry portal 112*b*. In these embodiments, first charge entry portal 112*a* may be an entry portal for charges proceeding into kiln 100 along first flow path 122, and second charge entry portal 112*b* may be an entry portal for charges entering kiln 100 along second flow path 126. Likewise, first charge exit portal 114*a* may be an exit portal for charges exiting kiln 100 along first flow path 122, and second charge exit portal 114*b* may be an exit portal for charges exiting kiln 100 along second flow path 126. In some embodiments, the only venting of the kiln is through the charge portals 112 and 114. In other embodiments, one or more vents may be provided in first chamber 110 and/or third chamber 140 to controllably regulate the temperature and manage any condensation or moisture congregation that may occur.

Alternatively, as shown in FIGS. 1*b*, 1*d*, 2*b*, and 2*d*, first chamber 110 may have a width that is substantially half the width of second chamber 120. In such embodiments, first chamber 110 may include one of the entry portals 112 and the other entry portal 112 may be provided in or near the proximal end of second chamber 120. In this configuration, lumber charges that require relatively more drying time or preheating may be routed along the flow path that passes through first chamber 110, and other lumber charges that require relatively less drying time or preheating may be routed along the other flow path that does not pass through first chamber 110.

FIGS. 2A-2D show examples of flow paths within unidirectional multi-path kilns. Guide members 108 may define the flow paths (e.g., where guide member 108 includes tracks or rails along support surface 102). Therefore, the following description of flow paths may also apply to corresponding guide members 108. In the illustrated examples, first flow path 122 may extend through a first side of the kiln from a first charge entry portal 112*a* to a first charge exit portal 114*a*. Likewise, a second flow path 126 may extend through an opposite second side of the kiln from a first charge entry portal 112*b* to a first charge exit portal 114*b*. The first and second flow paths 122/126 may be substantially parallel and on opposite sides of a longitudinal axis 125 of second chamber 120. Lumber charges may be conveyed along the first and second flow paths in the same direction of travel (Arrows A and B).

Some embodiments may include more than two flow paths. For example, a unidirectional multi-path kiln can have three, four, five, or more than five flow paths arranged in parallel. Again, a single transport assembly 150 may be used to move lumber charges along each path simultaneously. Alternatively, two or more transport assemblies may be provided.

Embodiments with a third chamber 140 may have intermediate charge portals 124*a* and 124*b* positioned between second chamber 120 and third chamber 140. Intermediate charge portals 124*a*/124*b* may be provided with one or more insulating members (e.g., a door) that are selectively actuable to open as a lumber charge reaches the distal end of second chamber 120 and passes into third chamber 140, and to close again once the lagging end of the lumber charge has entered third chamber 140. This may minimize the passage of heat/steam from second chamber 120 to third chamber 140 and/or through charge exit portal 114*a*/114*b*. In a particular embodiment, one or more sensors may be provided along a flow path to detect a position of a lumber charge, and a computing system receiving data from the sensors may control operation of any or all of the charge portals based on sensor data and other factors (e.g., drying schedule, conditions within the drying chamber, rate of lumber charge travel, etc.) This may improve energy efficiency and/or aid in the flow of moist heated air from second chamber 120 to flow toward chamber 110. Alternatively, intermediate charge portals 124*a*/124*b* may be provided with an insulating member configured to be pushed aside by the passage of a lumber charge (e.g., a polymer curtain, a vertical strip curtain, or swinging doors).

As shown for example in FIG. 2E, third chamber 140 may be a pair of smaller chambers added to the distal end of second chamber 120. Again, third chambers 140*a*/140*b* may be sized to accommodate a single lumber charge of a standard size, or any number/size of lumber charges. Optionally, charge exit portals 114*a*/114*b* may be selectively actuable to open as a lumber charge reaches the distal end of third chamber 140, and to close again once the lagging end of the lumber charge has exited third chamber 140. Alternatively, charge exit portals 114*a*/114*b* may be selectively actuated or controlled by a computing system as described above for intermediate charge portals 124*a*/124*b*. As another alternative, charge exit portals 114*a*/114*b* may be selectively actuated or controlled to open and/or close once a predetermined length of time has elapsed after opening/closing intermediate charge portals 124*a*/124*b*. In some embodiments, charge exit portals 114*a*/114*b* may be provided with an insulating member configured to be pushed aside by the passage of a lumber charge as described above.

FIGS. 3A-D illustrate more detailed plan views of the kilns of FIGS. 1A-D, in accordance with various embodiments. In these examples, chamber 110 includes subsections 10*a* and 10*b*, chamber 120 includes subsections 12*a*, 12*b*, 12*c*, and 12*d*, and chamber 140 (FIGS. 3A, 3B) includes subsection 14. Fans 170 may be provided in some or all of the chambers/subsections and positioned to circulate air around the lumber charges. Fans 170 may be coupled to corresponding drives 174. In some embodiments, a third chamber 140 may lack a fan and corresponding drive.

Some chambers, sections, or subsections may optionally be separated by one or more baffles 118 (indicated by broken lines). Baffles 118 may reduce the loss of heat and steam from the kiln by reducing the migration of moist, heated air between adjacent subsections (e.g., reduce migration of air from subsection 10*b* to subsection 10*a*). This may increase the efficiency of pre-heating/cooling and aid temperature regulation in adjacent chambers/subsections by minimizing fluctuations in temperature within those areas. Minimizing temperature fluctuations and reducing the migration of moisture between adjacent subsections may allow the green lumber to be pre-heated/cooled at a selected optimal rate, which may help to reduce or prevent defects from overly rapid drying or cooling of the lumber. Other embodiments may include additional subsections, fewer subsections, or no subsections.

Figure 3A:
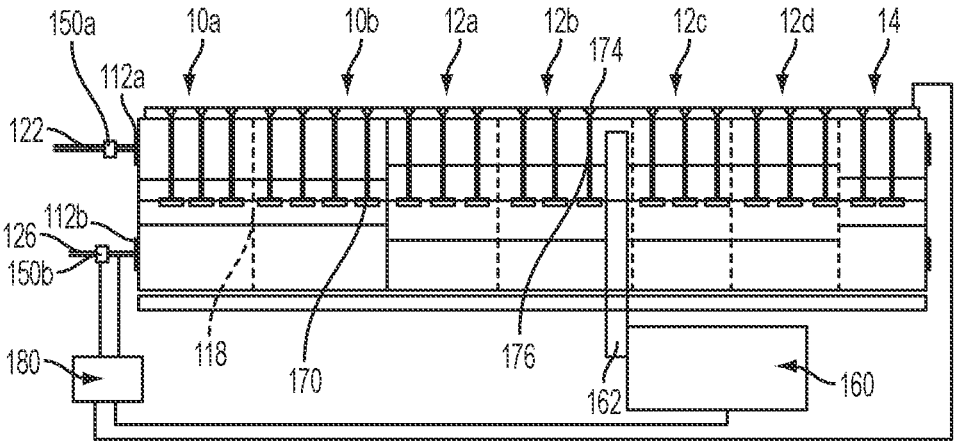
FIGS. 3A-D illustrate more detailed plan views of unidirectional multi-path kilns as illustrated in FIGS. 2A-D.
Figure 3B:
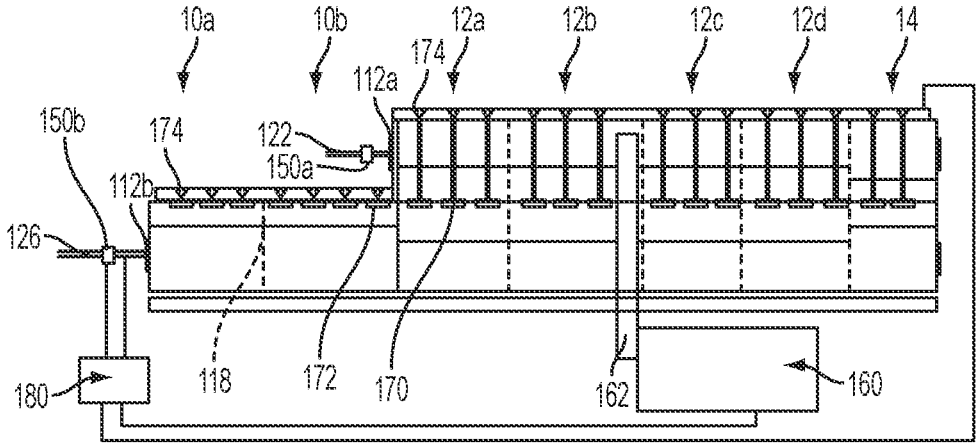
Figure 3C:
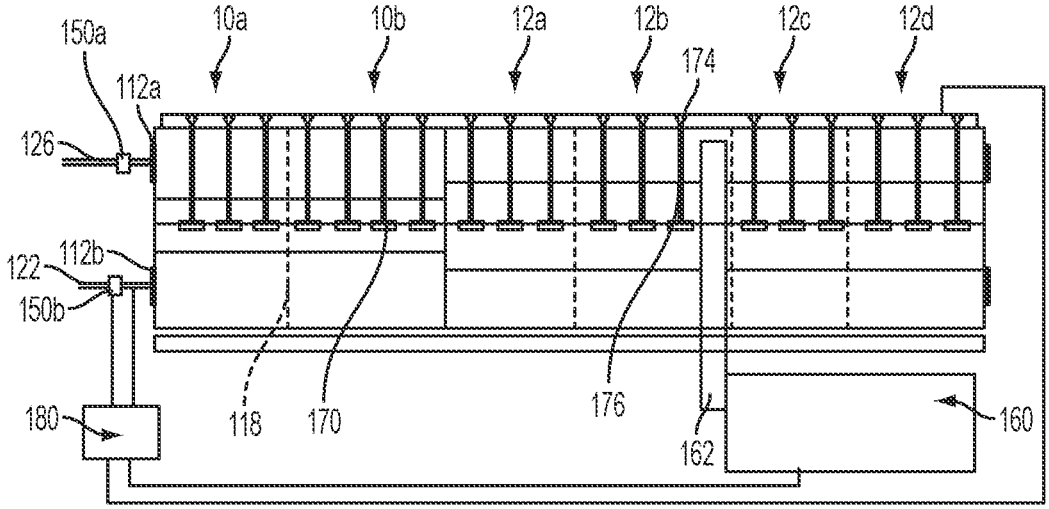
Figure 3D:
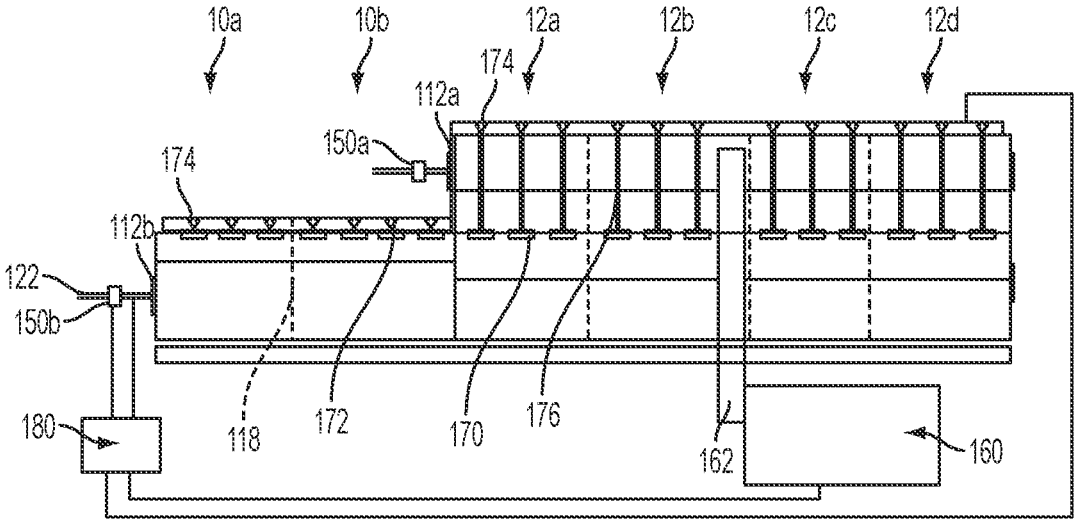

Subsections 10*a* and 10*b* may include subsections one or more fans 170 positioned to circulate air and steam received from chamber 120 around lumber charges proceeding through first chamber 110, a first preheat side that includes charge entry portal 112*a*, and a second preheat side that includes charge entry portal 112*b*. Within first chamber 110, fans 170 may circulate air across green lumber charges progressing in the same direction along the two flow paths toward the exit portals 114*a*/114*b*. In other embodiments, first chamber 110 (e.g., subsections 10*a* and 10*b*) may have only one preheat side and the corresponding charge portal (FIGS. 3B, 3D). In either case, fans 170 may circulate air across the lumber charges to preheat the lumber.

Subsections 12*a*, 12*b*, 12*c*, and 12*d* of second section 120 may be supplied with heated air by a fan and duct system 162 coupled to a heater 160. Any or all of subsections 12*a-d* may include heating members, such as a vertical booster coil assembly between the first and second sides and/or heating coils extending horizontally near fans 170, to maintain or increase the temperature of the circulating air. Optionally, one or more heating members may be provided in first chamber 110 and/or third chamber 140. These heating members may be selectively controlled to maintain a desired temperature within a chamber, section, or subsection, or a desired temperature differential between adjacent chambers, sections, or subsections.

The influx of heated air and the higher temperatures within section 120 may result in a pressure differential between section 120 and the entry charge portals 112*a*/112*b*. The entry, exit, and intermediate charge portals may be the primary, or the only, source of ventilation in kiln 100. Thus, in embodiments with intermediate portals/insulated charge exit portals, the pressure differential may enhance the flow of heat and moisture from second chamber 120 toward the proximal end of first chamber 110 and reduce the flow of heat and moisture in the opposite direction (i.e., from second chamber 120 toward the distal end of kiln 100). This design may provide more efficient preheating of lumber than in prior continuous kilns.

Optionally, fans 170 may be reversible fans configured to rotate in two opposite rotary directions. Likewise, drives 174 may be reversible drives (i.e., configured to drive fans 170 in two opposite rotary directions). However, because of the pressure gradient and unidirectional flow path, fans 170 and/or drives 174 may be unidirectional instead of reversible. Using unidirectional fans/drives may reduce costs and/or energy use associated with operating kiln 100.

In one embodiment, fans 170 within second chamber 120 and/or third chamber 140 may be operated at a greater rotational speed than fans within first chamber 110. As a result, the velocity of circulating air may be greater in second chamber 120 and/or third chamber 140 than in first chamber 110. The air velocity may be progressively reduced among subsections nearer to the charge entry portals 112*a*/112*b*.

In operation, a first stack of green lumber is placed on a movable support 190, and a transport assembly 150 pushes or pulls movable support 190 into a first end of kiln 100 either through first charge portal 112*a* and along first flow path 122, or through second charge portal 112*b* and along second flow path 126. Green lumber passing through first chamber 110 is pre-heated by steam flowing from second chamber 120 as the corresponding movable support(s) 190 proceeds toward second chamber 120.

The green lumber is heated and continues to lose moisture as the green lumber charges on movable supports 190 proceed through second chamber 120. In some embodiments, the first and second sides of second chamber 120 may be divided by a wall or other structure that reduces direct airflow from the first side to the second side. Optionally, one or more heaters may be provided within second chamber 120 to increase air temperature/pressure. In other embodiments, second chamber 120 may lack heaters and/or a longitudinal dividing structure.

In some embodiments, the dried lumber charges may exit second chamber 120 through exit charge portals 114*a*/114*b*. In other embodiments, the dried lumber charges may proceed from second chamber 120 into third chamber 140. Optionally, the lumber charges may pass through intermediate charge portals 124*a*/124*b* provided between second chamber 120 and third chamber 140. The temperature within third chamber 140 may be lower than the temperature within second chamber 120. This may allow the green lumber to reach a more uniform temperature or moisture content (e.g., reduce the difference between the outer surface temperature/moisture and interior temperature/moisture). Third chamber 140 may be provided with one or more fans 170 positioned to circulate air around the lumber.

The travel time of the lumber charges may vary depending on various factors. Lumber charges traveling along one flow path may be moved through the kiln at a faster rate than lumber charges traveling along another flow path. The movable supports may be moved along a flow path at a predetermined rate (e.g., 1-10 feet/hour, 3-7 feet/hour, 4-6 feet/hour, or 5 feet/hour). Lumber charges on movable supports may be moved continuously through the kiln along the flow paths. Alternatively, the charges may be moved discontinuously along the flow paths. This could be accomplished by moving the movable supports a desired distance, pausing for an interval of time, and moving the movable supports another desired distance. The distances may be incremental (e.g., increments of 1-5 feet, 2-4 feet, 3-6 feet, 1 foot, 2 feet, etc.).

In some embodiments, a lumber charge may be moved a greater distance or at a faster rate along one portion of the flow path than along another. In a specific example, a lumber charge may be moved continuously or incrementally within second chamber 120. With the leading end of the lumber charge positioned at the distal end of second chamber 120, the lumber charge may be moved into third chamber 140 without pausing until the lagging end of the lumber charge has entered third chamber 140. Thus, when the leading end of a 15-foot lumber charge reaches the distal end of second chamber 120, the lumber charge may be moved continuously over a distance of, or in a single increment of, 15-20 feet until the lagging end exits second chamber 120. The lumber charge may be moved at a faster rate along this portion of the flow path than other portions of the flow path in order to reduce the migration of moist heated air from second chamber 120 to third chamber 140. Similarly, lumber charges positioned at or near a charge exit portal 114*a*/114*b* may be moved through the charge exit portal continuously and/or at a relatively greater speed than the speed of travel through second chamber 120.

The moisture content of the lumber charges may be monitored as the charges progress through the kiln. The rate at which the lumber charges are moved through the kiln and conditions within the chambers/subsections may be adjusted by a computing system based on factors such as initial moisture content of the lumber, humidity, temperature/pressure within a chamber, fan speeds, velocity of air flow, external ambient temperature/humidity, lumber species, lumber dimensions, desired moisture content, and/or input by a human operator.

Figure 5:
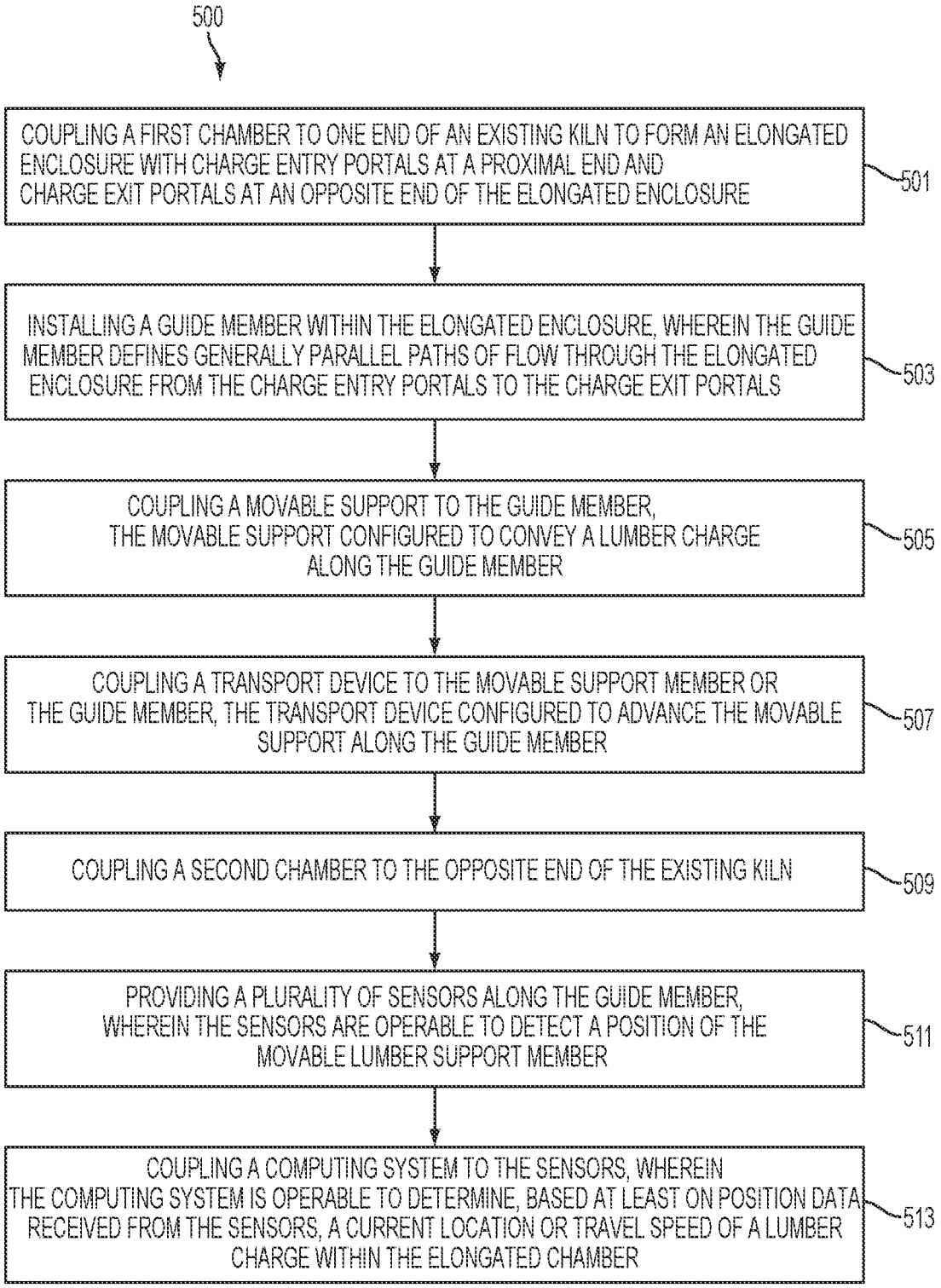
FIG. 5 is a flow diagram of a method for converting an existing kiln to a unidirectional multi-path kiln.

FIG. 5 is a flow diagram of a method for converting an existing kiln to a unidirectional multi-path kiln, in accordance with various embodiments.

In some embodiments, method 500 may begin at block 501. At block 501, a first chamber (e.g., chamber 110) may be coupled to one end of an existing kiln (e.g., second chamber 120) to form an elongated enclosure with entry charge portals (e.g., charge portals 112*a*/112*b*) at a proximal end of the elongated enclosure. Corresponding exit charge portals (e.g., charge portals 114*a*/114*b*) may be provided at an opposite distal end of the elongated enclosure. At block 503, one or more guide members (e.g., guide member 108) may be installed within the elongated enclosure. The guide member(s) may be, but is not limited to, tracks, rails, or other such features. The guide member(s) may define two or more paths of flow (e.g., paths 122, 126) through the elongated enclosure from the entry charge portals to the exit charge portals.

At block 505, a movable support/member (e.g., movable support 190) may be coupled to the guide member. In some embodiments, the movable support member may be configured to convey a lumber charge along the guide member.

At block 507, a transport device (e.g., transport assembly 150) may be coupled to the movable support member or the guide member. The transport device may be configured to advance the movable support along the guide member. In some embodiments, the transport device may include a pusher device, a motor, and/or a pulley/winch. Some embodiments may include two or more transport devices, with each of the transport devices positioned along each of the paths of flow (see e.g., FIG. 1D). Optionally, a single transport device may be provided along or between paths of flow, and may be configured to move lumber charges along multiple flow paths (see e.g., FIG. 1C).

Optionally, at block 509 a second chamber may be coupled to the opposite end of the existing kiln (e.g., third chamber 140). In some embodiments, at block 511 a plurality of sensors may be provided along the guide member. The sensors may be operable to detect a position of the movable support member. In one embodiment, at block 513 a computing system may be coupled with the sensors. The computing system may be operable to determine, based at least on position data received from the sensors, a current location or travel speed of a lumber charge within the elongated chamber. In other embodiments, any or all of blocks 509, 511, and 513 may be omitted.

Figure 6:
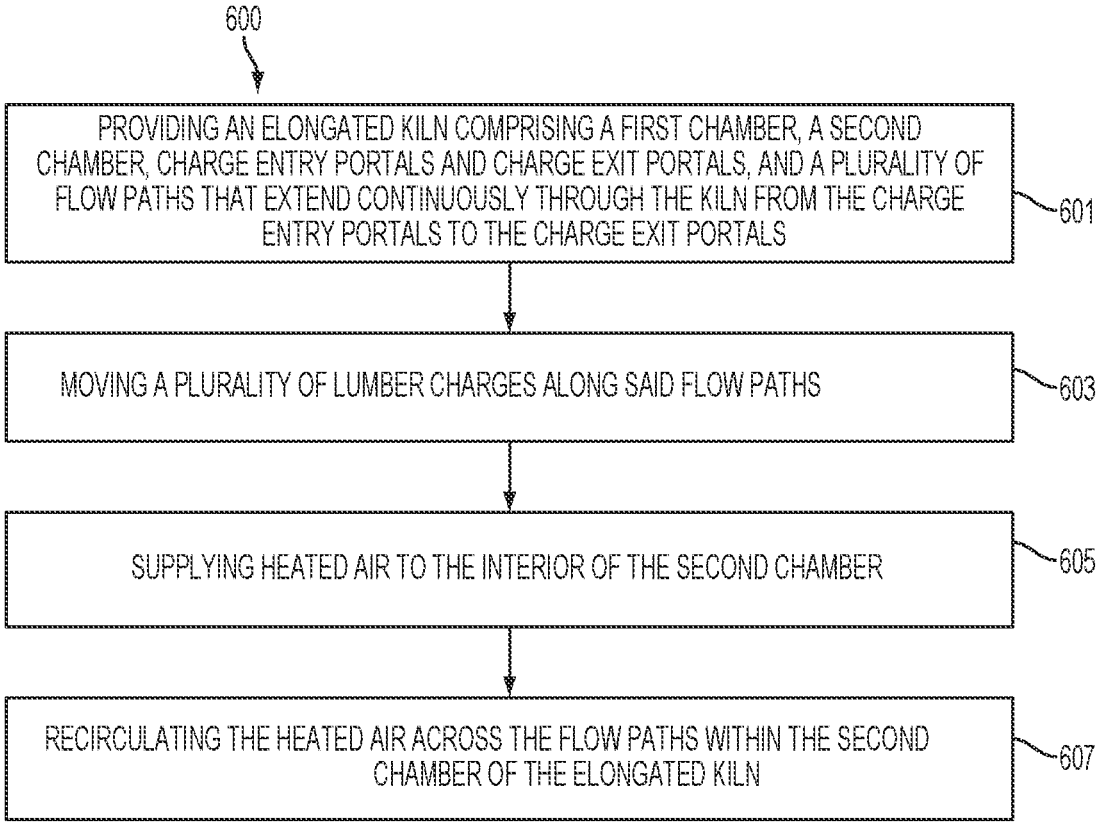
FIG. 6 is a flow diagram of a method for operating a unidirectional multi-path kiln, all in accordance with various embodiments.

FIG. 6 is a flow diagram of a method for operating a unidirectional multi-path kiln, all in accordance with various embodiments. In some embodiments, method 600 may begin at block 601. At block 601, an elongated kiln may be provided. The elongated kiln may include a first chamber (e.g., chamber 110), a second chamber (e.g., chamber 120), a charge entry portal (e.g., 112*a*/112*b*) and a charge exit portal (e.g., 114*a*/114*b*), and two or more flow paths (e.g., 122, 126) that extend through the kiln from the charge entry portals to the corresponding charge exit portals. In some embodiments, intermediate charge portals (e.g., 124*a*, 124*b*) may be provided between the second chamber and the third chamber (e.g., third chamber 140). The intermediate charge portals may be provided with insulating members and/or with doors that are selectively actuable to open and close as lumber charges pass through the distal end of the second chamber and into the third chamber.

At block 603, lumber charges may be moved along the flow paths. In some embodiments, two groups of lumber charges may be moved along corresponding ones of the flow paths in end-to-end arrangements by one or more pusher devices or other source(s) of motive force as discussed herein. At block 605, heated air may be supplied to the interior of the second chamber. At block 607, the heated air may be recirculated across the first and second portions of the flow paths. The heated air may dry the lumber as the lumber charges progress through the second chamber.

In some embodiments, lumber charges may be organized into batches according to characteristics that affect drying time (e.g., dimensions, species, end use, starting moisture content, desired moisture content, desired drying speed, etc.). The charges of a particular batch may be fed sequentially into the kiln before feeding the charges of the next batch into the kiln. This may allow lumber charges to be fed into the kiln and moved along the flow paths at a substantially constant rate. Alternatively, in kilns with one flow path that passes through first chamber 110 and another path that does not pass through first chamber 110 (see e.g., FIGS. 1B, 1D, 2B, and 2D), charges may be allocated among the flow paths based on whether the charges require preheating.

In a specific example, a first lumber charge is fed into the kiln through first charge entry portal 112*a* along first flow path 122 while a second lumber charge is simultaneously fed into the kiln through second charge entry portal 112*b* along second flow path 126. Additional lumber charges are fed into the kiln in the same or similar manner, and at the same or similar rate, such that the lumber charges are arranged in tandem series along each flow path. This may allow the charge portals along both flow paths to be operated (e.g., opened and closed) synchronously.

In addition to the discussion of various embodiments above, figures and additional discussion are presented herein to further describe certain aspects and various embodiments of the present invention. It is to be understood, however, that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A method of drying lumber in a lumber kiln, wherein the lumber kiln includes an elongated enclosure with a first end, an opposite second end, an interior with at least a first section and a second section adjoining the first section, a charge entry with one or more first charge portals at the first end, a charge exit with one or more second charge portals at the second end, a longitudinal axis that extends through the first and second sections and the first and second ends, a first guide member and a second guide member that define a first flow path and a second flow path, respectively, that are on opposite sides of the longitudinal axis and extend through the charge entry, the first and second sections, and the charge exit, a heat source operable to heat the second section, and one or more fans positioned to circulate heated air received from the second section across the first and second flow paths in the first section, the method comprising:

advancing a plurality of first lumber charges along the first flow path, and a plurality of second lumber charges along the second flow path, in a first direction of travel such that a first one of the first lumber charges and a first one of the second lumber charges are positioned within the second section while a second one of the first lumber charges and a second one of the second lumber charges are positioned within the first section; and operating the one or more fans to circulate the heated air received from the second section across the first and second flow paths in the first section to thereby move the heated air through the first and second lumber charges in the first section.

2. The method of claim 1, wherein each of the first lumber charges includes a respective stack of lumber, the method further including adjusting a rate at which the first lumber charges are advanced along the first flow path based at least on an initial moisture content of the lumber, a humidity or temperature or pressure within one of the first and second sections, a fan speed, an air flow velocity, an external ambient temperature/humidity, species of the lumber, dimensions of the lumber, desired moisture content of the lumber, or input by a human operator.

3. The method of claim 1, wherein the lumber charges include respective stacks of lumber supported on respective movable supports, the method further including organizing the lumber into at least a first batch and a second batch based on one or more lumber characteristics that affect drying time, wherein the first batch has a first expected drying time and the second batch has a second expected drying time; and forming the first lumber charges and the second lumber charges such that the first lumber charges include the first batch and the second lumber charges include the second batch.

4. The method of claim 3, wherein the one or more lumber characteristics includes at least one of dimensions, species, intended end use, starting moisture content, desired moisture content, and/or desired drying speed, of the stacks of lumber.

5. The method of claim 1, wherein the lumber charges include respective stacks of lumber supported on respective movable supports, the method further including:

organizing the lumber charges into a first batch and a second batch based on one or more lumber characteristics that affect drying time, wherein the first batch includes the first lumber charges and the second batch includes the second lumber charges.

6. The method of claim 5, wherein the first lumber charges have a first expected drying time and the second lumber charges have a second expected drying time that is different from the first expected drying time, the method further including allocating the first lumber charges to the first flow path and the second lumber charges to the second flow path based on the respective one or more lumber characteristics or the respective expected drying times.

7. The method of claim 6, wherein advancing the lumber charges along the first and second flow paths includes advancing the first lumber charges along the first flow path at a first rate that is based on the one or more lumber characteristics of the first batch or the first expected drying time, and advancing the second lumber charges along the second flow path at a second rate that is based on the one or more lumber characteristics of the second batch or the second expected drying time.

8. The method of claim 5, wherein the one or more lumber characteristics includes at least one of dimensions, species, intended end use, starting moisture content, desired moisture content, and/or desired drying speed, of the stacks of lumber.

9. A system for drying lumber, comprising:

an elongated enclosure having a first end and an opposite second end, an interior with at least a first section and a second section adjoining the first section, a charge entry with one or more first charge portals at the first end, a charge exit with one or more second charge portals at the second end, a longitudinal axis that extends through the first and second sections and the first and second ends, a first guide member and a second guide member disposed on opposite sides of the longitudinal axis and defining respective first and second flow paths that extend through the first and second sections and the first second ends, a heat source operable to heat the second section, and one or more first fans operable to circulate heated air from the second section across the first and second flow paths within the first section; and a transport system selectively operable to advance a first lumber charge and a second lumber charge in a first direction along the first flow path and the second flow path, respectively.

10. The system of claim 9 wherein the interior has a third section, the second section is between the first section and the third section, the first section is at the first end, and the third section is at the second end.

11. The system of claim 9, wherein each of the first and second guide members includes a corresponding set of rails or a track.

12. The system of claim 9, wherein the transport system includes a first transport device operable to advance the first lumber charge along the first flow path and a second transport device operable to advance the second lumber charge along the second flow path.

13. The system of claim 9, wherein the first and second transport devices are pusher devices.

14. The system of claim 9, wherein the transport system includes a transport device operable to advance the first lumber charge and the second lumber charge simultaneously along the first flow path and the second flow path, respectively.

15. The system of claim 14, wherein the transport device is a pusher device.

16. A method of modifying a lumber kiln to form a unidirectional kiln, wherein the lumber kiln has an elongated enclosure with a first end and an opposite second end, an interior with at least a first section and a second section adjoining the first section, a charge entry with one or more first charge portals at the first end, a charge exit with one or more second charge portals at the second end, a longitudinal axis that extends through the first and second sections and the first and second ends, a first guide member and a second guide member disposed on opposite sides of the longitudinal axis and defining respective first and second flow paths that extend through the first and second sections and the first and second ends, a heat source operable to heat the second section, and one or more first fans operable to circulate heated air from the second section across the first and second flow paths within the first section, the method comprising:

operatively coupling a transport system with the lumber kiln, wherein the transport system is selectively operable to advance a first lumber charge in a first direction along the first flow path and to advance a second lumber charge in the first direction along the second flow path.

17. The method of claim 16, wherein the transport system includes a first transport device operable to advance the first lumber charge along the first flow path and a second transport device operable to advance the second lumber charge along the second flow path.

18. The method of claim 16, wherein the first and second transport devices are pusher devices, and operatively coupling the transport system with the lumber kiln includes positioning the first pusher device along the first flow path and positioning the second pusher device along the second flow path.

19. The method of claim 16, wherein the transport system includes a winch, a pusher device, or an endless loop.

20. The method of claim 16, wherein the transport system includes a first pusher device configured to engage the first and second lumber charges simultaneously.

21. The method of claim 14, further including operatively coupling a computing system with the transport system, wherein the computing system is operable to control the transport system to thereby control a rate at which the first lumber charge is moved through the elongated enclosure based at least on an initial moisture content of the lumber, a humidity or temperature or pressure within one of the first and second sections, a fan speed, an air flow velocity, an external ambient temperature/humidity, species of the lumber, dimensions of the lumber, desired moisture content of the lumber, or input by a human operator.

22. The method of claim 21, further including operatively coupling the computer system with one or more sensors positioned to detect the first lumber charge along the first flow path, wherein the computing system is further configured to determine, based at least on data received from the one or more sensors, a current location or travel speed of the first lumber charge.

* * * * *